US007364228B2

(12) United States Patent
Entz

(10) Patent No.: US 7,364,228 B2
(45) Date of Patent: Apr. 29, 2008

(54) COLLAPSIBLE WHEELCHAIR FRAME

(75) Inventor: Keith E. Entz, Whitewater, KS (US)

(73) Assignee: Aero Innovative Research, Inc., Valley Center, KS (US)

( * ) Notice: Subject to any disclaimer, the term of this patent is extended or adjusted under 35 U.S.C. 154(b) by 63 days.

(21) Appl. No.: 10/964,539

(22) Filed: Oct. 13, 2004

(65) Prior Publication Data

US 2006/0076806 A1 Apr. 13, 2006

(51) Int. Cl.
*A47C 4/00* (2006.01)

(52) U.S. Cl. ..... 297/44; 297/DIG. 4; 280/647

(58) Field of Classification Search ..... 280/642, 280/647, 650, 657; 297/DIG. 4, 42, 440.12, 297/351, 44, 440, 12; 135/67, 74
See application file for complete search history.

(56) References Cited

U.S. PATENT DOCUMENTS

| | | | | | |
|---|---|---|---|---|---|
| 2,649,309 | A | | 8/1953 | Deissner | |
| 2,847,058 | A | | 8/1958 | Lee | |
| 3,142,351 | A | | 7/1964 | Green | |
| 3,833,256 | A | | 9/1974 | Dehner | |
| 4,026,568 | A | * | 5/1977 | Hallam | 280/42 |
| 4,101,143 | A | | 7/1978 | Sieber | |
| 4,335,983 | A | | 6/1982 | Wermeister et al. | |
| 4,625,984 | A | | 12/1986 | Kitrell | |
| 4,630,861 | A | * | 12/1986 | Henschel | 297/44 |
| 4,693,490 | A | * | 9/1987 | Loodberg et al. | 280/650 |
| 4,770,432 | A | * | 9/1988 | Wagner | 280/250.1 |
| 4,917,395 | A | * | 4/1990 | Gabriele | 280/250.1 |
| 5,240,276 | A | | 8/1993 | Coombs | |
| 5,244,222 | A | | 9/1993 | Benoit | |
| 5,284,350 | A | * | 2/1994 | Geiger et al. | 280/250.1 |
| 5,285,535 | A | * | 2/1994 | Stewart et al. | 4/480 |
| 6,079,772 | A | * | 6/2000 | Green | 297/16.1 |
| 6,135,475 | A | * | 10/2000 | Brown et al. | 280/250.1 |
| 6,241,275 | B1 | | 6/2001 | Slagerman | |
| 6,839,918 | B1 | * | 1/2005 | Jensen | 4/480 |
| 2005/0211285 | A1 | * | 9/2005 | Cowie et al. | 135/74 |

FOREIGN PATENT DOCUMENTS

| | | |
|---|---|---|
| EP | 0826355 | 3/1998 |

OTHER PUBLICATIONS

Sandmark, Inge. WO 90/14064, Nov. 29, 1990.*

* cited by examiner

*Primary Examiner*—Sarah B. McPartlin
(74) *Attorney, Agent, or Firm*—Kenneth H. Jack; Davis & Jack, L.L.C.

(57) ABSTRACT

A collapsible wheelchair frame having left and right side plates, each having an upper end, a lower end, and a forward end, each forward end forming a forwardly and downwardly and extending leg; left and right seat plates, each seat plate having proximal and distal ends, the proximal ends of the left and right seat plates being respectively hingedly attached to the upper ends of the left and right seat plates, the distal end of the left seat plate being hingedly attached to the distal end of the right seat plate; and left and right brace plates, each brace plate having proximal and distal ends, the proximal ends of the left and right brace plates being respectively hingedly attached to the lower ends of the left and right side plates, the distal end of the left brace plate being hingedly attached to the distal end of the right brace plate.

7 Claims, 4 Drawing Sheets

COLLAPSIBLE WHEELCHAIR FRAME

FIELD OF THE INVENTION

This invention relates to apparatus adapted for assistance of persons having ambulatory impairment. More particularly, this invention relates to manually driven wheelchairs having frames or chassis capable of alternately articulating to a rigid use configuration and collapsing to a relatively compact storage configuration.

BACKGROUND OF THE INVENTION

Conventional collapsible tube frame wheelchairs typically comprise metal left and right side frame weldments which are laterally interconnected by either one or two scissoring "X" braces. Lower ends of the "X" brace or braces of such a conventional wheelchair are typically pivotally attached to lower longitudinally extending members of the side frame weldments, while the upper ends of the "X" brace or braces are rigidly attached to left and right longitudinally extending sling seat suspending "T" bars. Forward and rearward ends of such "T" bars typically slidably engage vertically extending tube members of the left and right side frames, and a flexible sling seat typically spans between the "T" bars. As a user of such conventional wheelchair sits upon the sling seat, the left and right "T" bars are drawn and slidably guided downwardly within the left and right frame weldments, resulting in simultaneous downward scissoring and lateral splaying the "X" brace, laterally articulating the wheelchair to a width sufficient to accommodate the seated user. Alternately, in order to compactly collapse such conventional wheelchair, the left and right side frame weldments are manually drawn together, upwardly scissoring the "X" brace while simultaneously flexibly folding the sling seat and slidably moving the "T" bars and sling seat upwardly with respect to the side frame weldments.

A problem or deficiency associated with such conventional tube frame/"X" brace collapsible wheelchairs is that neither leg of the "X" brace is capable of pivoting to an orientation which is in closely articulated proximity with the side frame member from which the leg extends. In its maximally collapsed configuration, both legs of such "X" brace continue to extend angularly away from its side frame. Such limitation upon "X" brace leg pivoting action results in an undesirable limitation upon the wheelchair's ability to compactly laterally collapse.

In addition to a capability for compact collapsibility, wheelchairs are also desirably light in weight. A commonly known means for reducing the weight of metal tube weldments, without unduly compromising strength characteristics, is to increase the diameter of tube members of the structure, while dramatically decreasing tube wall thickness. Such design approach beneficially reduces the overall mass of the weldment. However, such approach to lightening tube frame structures is problematic when applied to collapsible wheelchairs because increasing the diameters of the frame's tube members further interferes with or disrupts the desirable compact collapsibility function.

The instant inventive collapsible wheelchair frame solves or ameliorates problems discussed above by providing a unique and novel hinged assembly of preferably lightweight yet strong panels or plates which are capable of alternately outwardly articulating to a rigid wheelchair box frame or chassis configuration and collapsing to a compact wheelchair storage configuration, such collapsing capability preferably approaching a compact stacked panel configuration.

BRIEF SUMMARY OF THE INVENTION

Major structural components of the instant inventive collapsible wheelchair frame preferably comprise left and right panels which are sectioned to respectively include left and right medial side sections or side plates, left and right upper seat sections or seat plates, and left and right lower brace sections or brace plates. Each of such panel sections or plates necessarily has upper and lower ends, the lower ends of the upper seat sections or seat plates along with the upper ends of the lower brace sections or brace plates being appropriately alternately described as proximal ends. Each plate or panel section end which is opposite one of such proximal ends is correspondingly describable as a distal end.

Preferably, forward ends of the left and right panels' medial side sections or side plates are configured for service as forwardly and downwardly extending legs. Distal or lower ends of such legs are preferably adapted for fixed and rotatable attachments of conventional left and right caster fork and wheel assemblies.

The proximal ends of the seat sections or plates are preferably respectively hingedly attached to the upper ends of the left and right medial side sections or side plates. Similarly, the proximal ends of the left and right brace sections or brace plates are preferably respectively hingedly attached to the lower ends of the left and right side sections or side plates. Distal ends of the left and right seat sections or seat plates are hingedly attached to each other, and distal ends of the left and right brace sections or brace plates are similarly hingedly attached to each other. Said pair of distal end hinged attachments are preferably the sole points of connection between the frame's left and right panels.

The plurality of hinged attachments referred to above preferably consist of first, second, third, fourth, fifth, and sixth hinges, each preferably comprising a full seam length "piano" hinge. The first hinge preferably interconnects the right panel's upper seat section or seat plate and the left panel's upper seat section or seat plate. The second hinge preferably interconnects the left panel's upper seat section or seat plate and the left panel's side section or side plate. The third hinge preferably interconnects the left panel's side section or side plate and the left panel's brace section or brace plate. The fourth hinge preferably interconnects the left panel's brace section or brace plate and the right panel's brace section or brace plate. The fifth hinge preferably interconnects the right panel's brace section or brace plate and the right panel's side section or side plate. Finally, the sixth hinge preferably interconnects the right panel's side section or side plate and the right panel's seat section or seat plate.

Preferably, all of the displacements of the distal ends of plates away from their proximal ends are equal so that, upon maximal hinged extension (without hyper-extension) of the seat plates and the brace plates, the left and right side sections or plates remain vertically oriented and remain in parallel alignment with each other, forming substantially orthogonal and rigid box frame.

An hyper-extension stop operatively connected to or formed wholly with the left and right seat plate or seat panel sections is preferably provided. Such means preferably comprises an installation of the above referenced first hinge at the distal or upper ends of the left and right seat plates in a butt hinge configuration allowing extreme distal end surfaces of such plates to abuttingly engage each other upon maximal hinged extension of such plates. Provided that the pivot axis of the first hinge resides at a lower or inner end of such abutting plate ends, such abutting engagement desirably stops any hyper-extending motion of the plates. Suitably, though less desirably, the hyper-extension stopping means may comprise auxiliary latches, throw bars and the like which are adapted for releasably locking the left and right seat plates in their maximally extended positions. Where the hyper-extension stopping means is formed wholly with the left and right seat plates, comprising the preferred seat plate ends and hinge combination described above, such means advantageously utilizes the weight of a seated wheelchair user to hold or lock the left and right seat plates in their maximally extended positions, and alternately allows free and unimpeded flexion of the left and right seat plates toward each other while the frame is not in use.

The second and sixth hinges described above preferably interconnect the left and right seat plates and the left and right side plates in manners similar to that of the first hinge. Said hinges preferably comprise butt hinges installed so that, upon flexion of the left and right seat plates toward each other, the extreme proximal ends of the left and right seat plates may respectively pivot to positions wherein they overlie the upper ends of the left and right side plates. Such hinge configurations advantageously allow the left and right seat plates and side plates to collapsibly approach a substantially flat and compact paired panel configuration.

Similarly with the first, second, and sixth hinges, the third and fifth hinges described above preferably interconnect upper ends of the left and right brace sections or plates with lower ends of the left and right side sections or plates in butt hinge configurations. Like the butt hinge configurations of the second and sixth hinges, the third and fifth hinge configurations further facilitate compact collapsibility of the frame, approaching a compact paired and stacked panel configuration.

To further facilitate compact collapsibility of the frame assembly, upper and forward peripheries of the left and right brace sections or plates are preferably fitted so that, upon hinged flexion of such plates toward each other, such plates may respectively leftwardly and rightwardly swing beneath and at least partially underlie the left and right panels' forwardly and downwardly extending legs. Such preferred fit of the brace plates with respect to the side plates further enables the frame assembly to collapsibly assume the preferred compact paired panel configuration.

While the proximal and distal ends of the left and right seat plates, along with the upper ends of the left and right side plates, are preferably horizontally oriented, the proximal ends of the left and right brace plates, the lower ends of the left and right side plates and the pivot axes of the third and fifth hinges are preferably substantially forwardly canted from the horizontal. Angular canting of such structures advantageously allows the left and right brace plates, upon full lateral extension, to jointly function as a truss member reinforcing and supporting the left and right side plates, and resisting movements and rotations of the left and right sides plates with respect to each other.

High density polyurethane foam sheet material clad with aluminum sheet material constitutes a preferred composition of the plates and panels of the instant invention. Suitably, extruded aluminum tube panels may be substituted. Also suitably, numerous other light yet strong laminate composite sheet materials may be substituted.

Accordingly, it is an object of the instant invention to provide a collapsible wheelchair frame comprising sectioned and inter-hinged left and right panels.

A further object of the instant invention is the provision a collapsible wheelchair frame which comprises a hinged assembly of six plates which is capable of articulating into a rigid box frame.

Other and further objects, benefits, and advantages of the instant invention have been described above are further explained in the detailed description which follows, and further appear in the appended drawings.

DETAILED DESCRIPTION OF A PREFERRED EMBODIMENT

Figure 1:
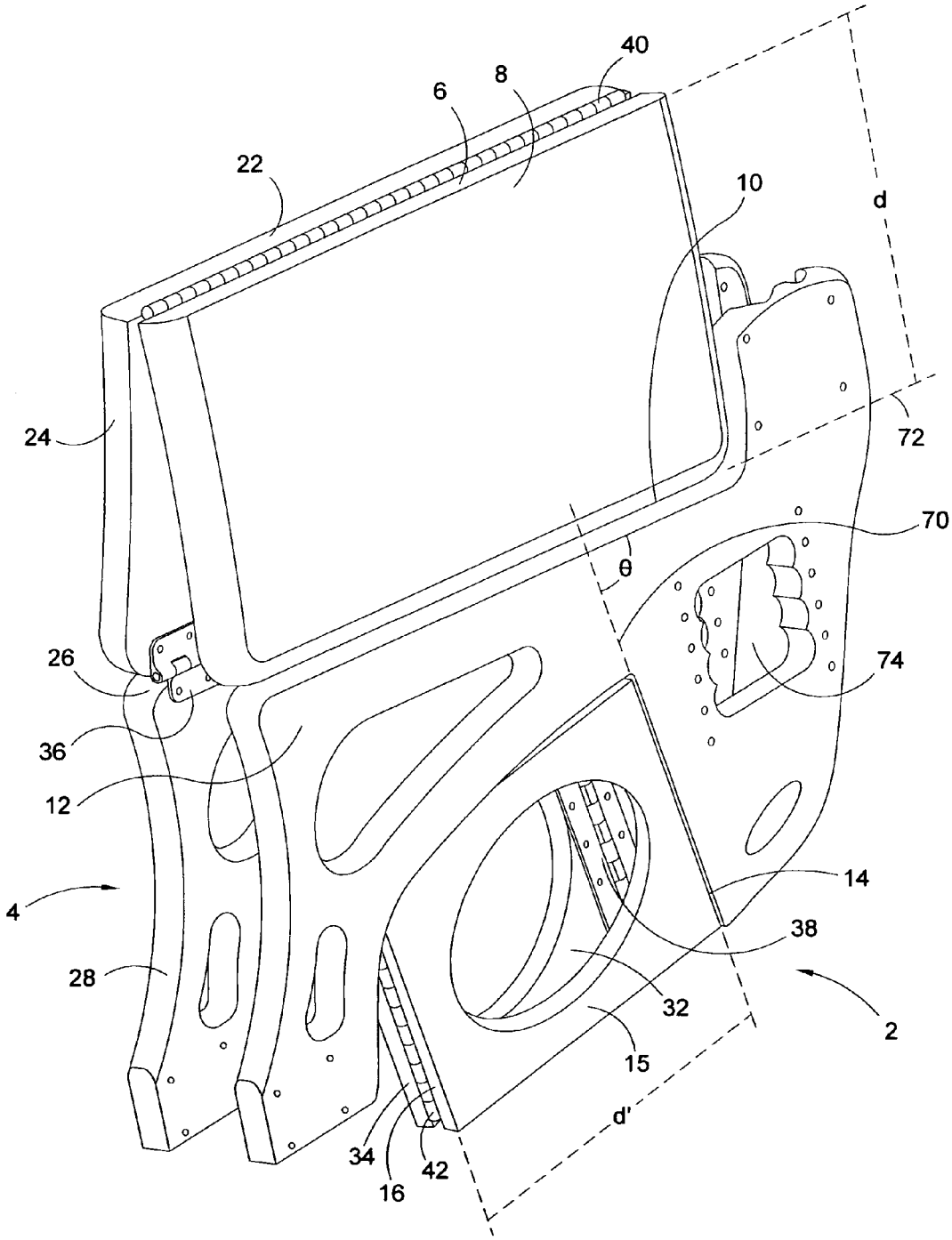
FIG. 1 is an isometric view of the instant inventive collapsible wheelchair frame, the view showing the frame in a nearly completely collapsed configuration.
Figure 2:
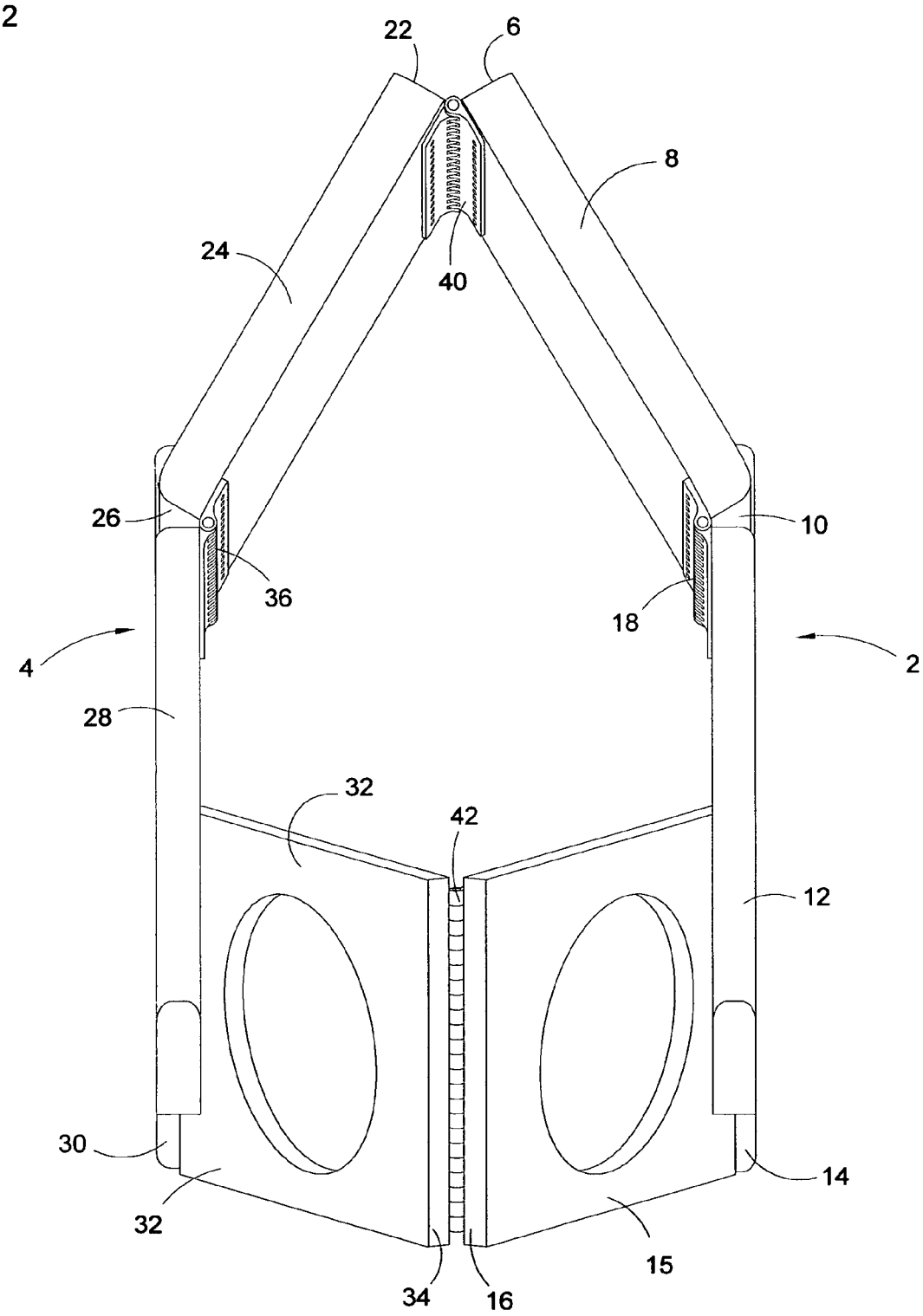
FIG. 2 is a front view of the instant inventive collapsible wheelchair frame, the view showing such frame in a partially collapsed (or partially articulated) configuration.

Referring now to the drawings, and in particular to FIG. 1, the instant inventive collapsible wheelchair frame preferably comprises a left panel referred to generally by Reference Arrow 2 and a right panel referred to generally by Reference Arrow 4. Referring further simultaneously to FIG. 2, the left and right panels 2 and 4 are preferably sectioned into plates or subsections by seams 10, 14, 26, and 30. Seam 10 borders and defines an upper seat plate or seat subsection 8 of left panel 2, and seam 10 correspondingly defines an upper end of side plate or side section 12 of left panel 2. A "piano" hinge 18 preferably spans seam 10, interconnecting the proximal end of plate 8 with the upper end of plate 12 in a butt hinge configuration, such configuration advantageously allowing plate 8 to pivotally move toward a compact flat panel configuration with respect to plate 12.

Referring further to FIGS. 1 and 2, rightwardly oriented plates 24 and 28, along with hinge 36 mirror plates 8 and 12 and hinge 18. Similarly with hinge 18 and plates 8 and 12, the butt hinge configuration of hinge 36 spanning seam 26 allows plates 24 and 28 to pivotally extend to a compact flat panel configuration.

Figure 4:
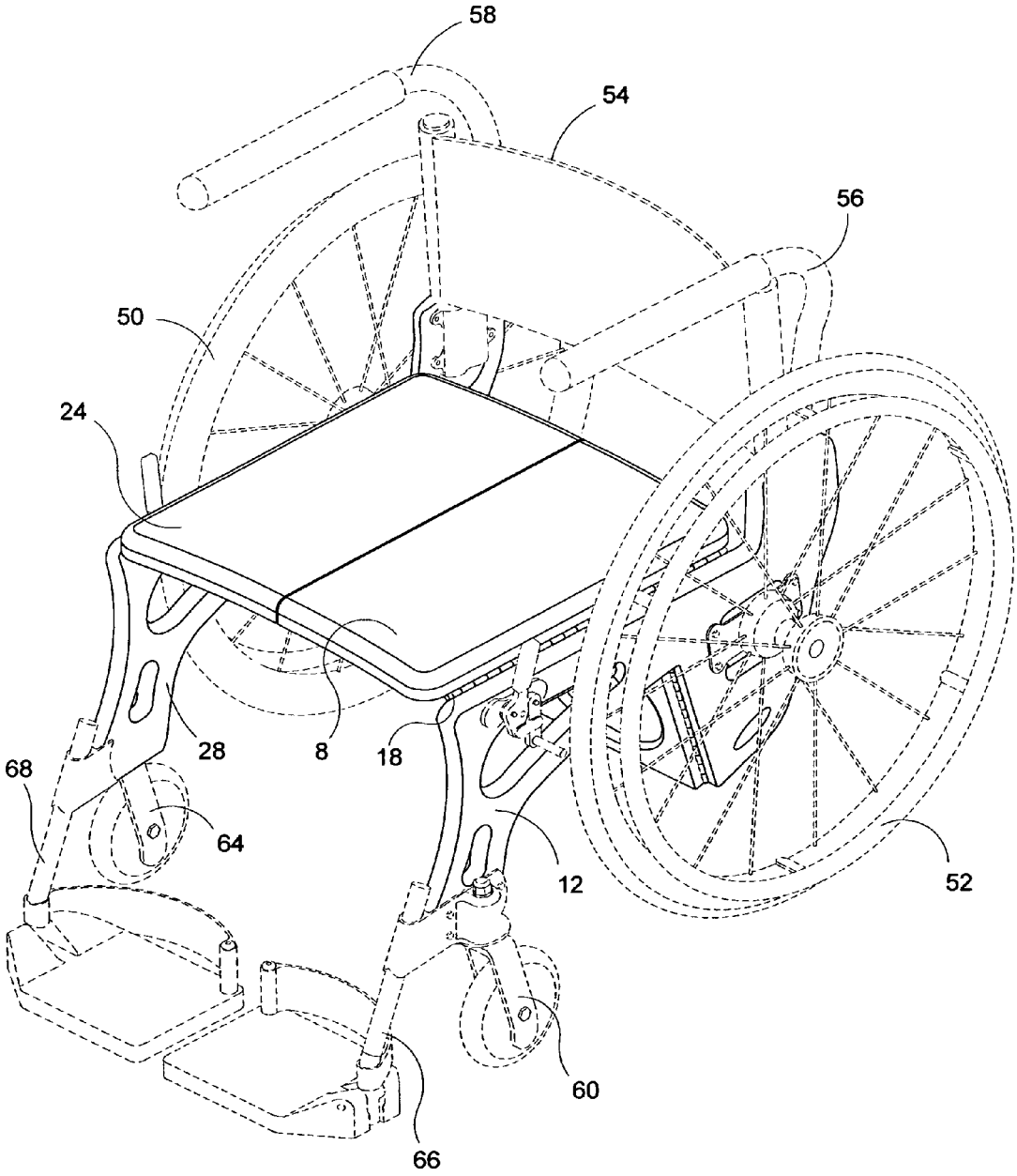
FIG. 4 redepicts FIG. 3, the view additionally showing in dashed lines the installation upon the frame of conventional wheelchair components.

Referring further to FIGS. 1 and 2, each of the left and right side panels or plates 12 and 28 preferably forms and defines a forwardly and downwardly extending leg whose lower or distal end is, referring further simultaneously to FIG. 4, adapted for attachment of a caster wheel assembly 60 or 64, and a foot rest assembly 66 or 68.

Figure 3:
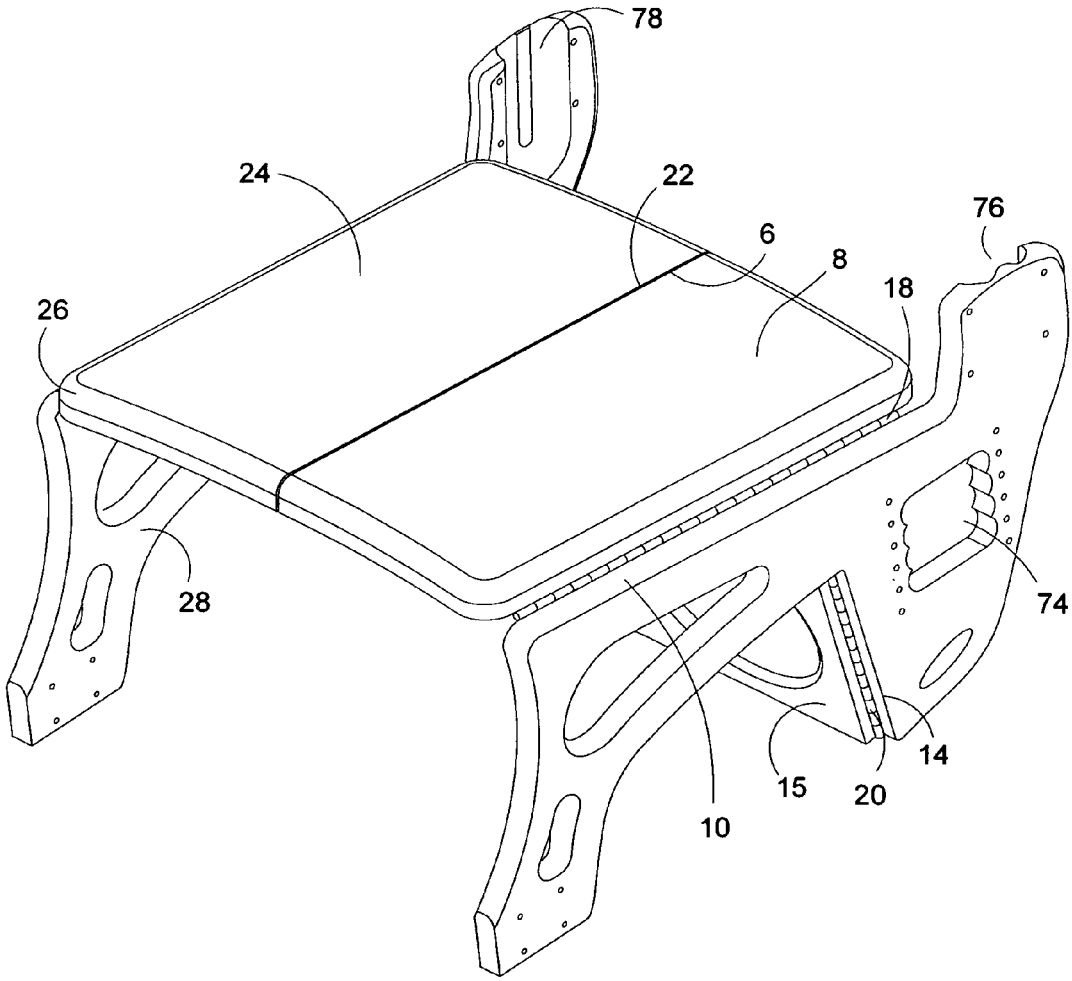
FIG. 3 is an isometric view of the instant inventive collapsible wheelchair frame, the view showing the frame in its fully articulated configuration.

Referring further simultaneously to FIGS. 1 and 2, the left and right panels 2 and 4 are preferably further sectioned to respectively include left and right lower brace sections or left and right brace plates 15 and 32. Referring further to FIG. 3, edge surfaces 14 and 30 of the left and right side plates 12 and 28 respectively comprise extreme lower ends of side plates 12 and 28. Hinges 20 and 38 respectively hingedly attach brace plates 15 and 32 to lower side plate ends 14 and 30 in a butt hinge configuration. Similarly with the butt hinge configurations of hinges 18 and 36 spanning seams 10 and 26, the butt hinge configurations of hinges 20 and 38 advantageously allow brace plates 15 and 32 to pivot to orientations wherein their extreme proximal ends respectively directly underlie the lower edge surfaces 14 and 30 of side plates 12 and 28. Such abutting orientations of plate ends desirably facilitates collapsible articulation to the compact panel configurations of panels 2 and 4.

As can be seen in FIGS. 1 and 3, the upper peripheries of brace plates 15 and 32 are fitted so that they may leftwardly and rightwardly pivot to positions underlying lower surfaces of the legs of side plates 12 and 28. Such fitted configurations of brace plates 15 and 32 further facilitates collapsible movements of such plates toward the compact and substantially flat panel configurations of panels 2 and 4.

Referring simultaneously to FIGS. 1 and 2, the extreme upper or distal ends of seat sections or plates 8 and 24 are identified by Reference Numerals 6 and 2. A hinge 40, preferably having an axis of pivotal motion in close proximity with the lower or inner ends of distal ends 6 and 22, spans between and interconnects seat plates 8 and 24. Referring further simultaneously to FIG. 3, upon extension of seat plates 8 and 24 from the position depicted in FIG. 1, through the position depicted in FIG. 2, and finally to the position depicted in FIG. 3, distal edges or ends 6 and 22 abuttingly engage each other, allowing the hinge 40 in combination with ends 6 and 22 to operatively function as an hyper-extension stop. In the position depicted in FIG. 3, application of the weight of a wheelchair user upon upper or outer surfaces of seat plates 8 and 24 drives distal end faces 6 and 22 against each other while such faces correspondingly oppose any hyper-extending collapse of the seat structure.

Referring to FIGS. 1, 2, and 3, hinge 16 preferably hingedly interconnects the distal ends 42 and 34 of brace plates 15 and 32. Preferably, the axis of pivotal motion of hinge 16 is parallel to the axes of pivotal motion of, referring further to FIG. 3, hinges 38 and 20. The axes of pivotal motion of hinges 20 and 38, the proximal ends of brace plates 15 and 32, and the lower ends 14 and 30 of side plates 12 and 28 are each preferably forwardly canted along line 70 at an angle θ with respect to a line 72 which horizontally extends along seam 10. For purposes of maximizing rigidity of the wheelchair frame upon outward articulation, the angle θ may be as great as 90°. However, such a severe cant or angle undesirably requires either vertically thinning the proportions of the frame's forwardly and downwardly extending legs, or vertically thinning the distal ends of brace plates 15 and 32, either of which may prohibitively compromise the strength of the frame. Accordingly, the angle θ is preferably 65° to 75°, facilitating enhanced vertical upper leg dimensions while retaining the preferred orthogonal configurations of brace plates 15 and 32.

Referring to FIG. 1, dashed line dimension indicators signify that the proximal and distal ends of seat plates 8 and 24 are displaced a distance d, and that the proximal and distal ends of brace plates 15 and 32 are displaced a distance d'. Preferably, plates 15, 32, 10, and 24 are configured so that d equals d'. Such equation of dimensions insures that the inventive wheelchair frame may articulate from the collapsed configuration depicted in FIG. 1 to the substantially orthogonally articulated configuration depicted in FIG. 3.

Referring simultaneously to FIGS. 3 and 4, the rearward ends of side sections or plates 12 and 28 preferably extend upwardly, such extensions inwardly presenting handle and seat back receiving recesses 76 and 78. Handles 56 and 58, along with seat back 54 are preferably bolted in place within recesses 76 and 78. Inclusion of recesses 76 and 78 within inner surfaces of side plates 12 and 28 advantageously allows the wheelchair frame to compactly collapse toward the preferred stacked pairing of panels 2 and 4 as depicted in FIG. 1 without experiencing interfering contact between inner surfaces of seat and side handle mounting brackets.

Referring to FIGS. 3 and 4, multi-positioning apertures 74 allow rear wheels 50 and 52 to be vertically adjustably attached to side panels 12 and 28.

Referring to all figures, the instant inventive wheelchair frame functions conventionally while in its articulated or expanded configuration. While not in use, an operator may pull upwardly upon seat plates 8 and 24, causing said plates to move pivotally toward each other. Simultaneously, brace plates 15 and 32 move pivotally toward each other. The simultaneous pivotal motions of said four plates draws side plates 12 and 28 toward each other while holding said plates in parallel alignment with each other. Upon full inward or collapsing articulation of plates 8, 22, 15, and 32, the inventive wheelchair frame assumes the compact configuration of substantially flat and stacked paired panels 2 and 4 as depicted in FIG. 1.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. A collapsible wheelchair frame assembly comprising:

(a) left and right side plates, each having an upper end, a lower end, a forward end, and a rearward end, each upper end comprising an upper edge, each forward end having a lower end, each forward end's lower end forming a forwardly and downwardly extending leg;

(b) left and right seat plates, each seat plate having proximal and distal ends, the proximal ends of the left and right seat plates being respectively hingedly attached to the upper ends of the left and right side plates, the hinged attachments of the proximal ends of the left and right seat plates being respectively positioned upon the upper ends of the left and right side plates so that the left and right side plates' upper edges substantially coincide with said hinged attachments, the distal end of the left seat plate being hingedly attached to the distal end of the right seat plate; and (c) left and right brace plates, each brace plate having proximal and distal ends, the proximal ends of the left and right brace plates being respectively hingedly attached to the lower ends of the left and right side plates, said hinged attachments being positioned between the left and right side plates' forward and rearward ends, the distal end of the left brace plate being hingedly attached to the distal end of the right brace plate.

2. The collapsible wheelchair frame assembly of claim 1 further comprising hyperextension stopping means connected operatively to or formed wholly with the left and right seat plates.

3. The collapsible wheelchair frame assembly of claim 2 wherein the hyperextension stopping means comprise the distal ends of the left and right seat plates.

4. The collapsible wheelchair frame assembly of claim 3 wherein, upon flexion of the left and right seat plates, their proximal ends respectively overlie the upper ends of left and right side plates.

5. The collapsible wheelchair frame assembly of claim 4 wherein, upon flexion of the left and right brace plates, the left and right brace plates respectively underlie the left and right side plates' legs.

6. The collapsible wheelchair frame assembly of claim 5 wherein the lower ends of the left and right side plates and the proximal ends of the left and right brace plates are forwardly canted.

7. The collapsible wheelchair frame assembly of claim 6 wherein each plate among the left seat plate, the right seat plate, the left brace plate, and the right brace plate has a length extending from its proximal end to its distal end, and wherein said each plate's length is substantially equal to the length of each other plate among said plates.

* * * * *